US005222678A

United States Patent [19]

Carrington

[11] Patent Number: 5,222,678

[45] Date of Patent: Jun. 29, 1993

[54] ROLL HOLDER WITH LANYARD FOR RETRACTING SUPPORT ASSEMBLY

[76] Inventor: Roy R. Carrington, 617 Vine St., Fulton, Mo. 65251

[21] Appl. No.: 803,011

[22] Filed: Dec. 4, 1991

[51] Int. Cl.[5] ..... B65H 19/00

[52] U.S. Cl. ..... 242/55.2

[58] Field of Search ..... 242/55.2, 55.53, 55.55, 242/68

[56] References Cited

U.S. PATENT DOCUMENTS

| | | | |
|---|---|---|---|
| 464,201 | 12/1891 | Rowland | 242/55.2 |
| 723,806 | 3/1903 | Avis | 242/55.2 |
| 1,153,389 | 9/1915 | Hudgel | 242/55.2 |
| 2,492,728 | 12/1969 | Balz | 242/55.2 |
| 2,500,514 | 3/1950 | Bozoti | 242/55.2 |
| 2,566,883 | 9/1951 | Gove | 242/55.2 |
| 3,392,928 | 7/1968 | Peterson | 242/55.3 |
| 3,643,884 | 2/1972 | Curtin | 242/55.2 |
| 4,326,678 | 4/1982 | Hamm | 242/55.2 |

*Primary Examiner*—Daniel P. Stodola
*Assistant Examiner*—John Rollins
*Attorney, Agent, or Firm*—Richard J. Grundstrom

[57] ABSTRACT

A rolled material holder comprising an improvement consisting of adapting a conventional rolled material holder, such as a toilet tissue roll holder, or any other type of similar rolled material holder which incorporates the same principles, to include a knob and a lanyard to release one end of the support assembly from a bore in one of the brackets. One end of the lanyard is securely attached to the knob through a hole in the knob. The other end of the lanyard is inserted through a hole in one of the bores in one of the brackets and extended through a hole in the nipple of the first tubular section. The lanyard is then extended through the center of the spring contained within the first tubular section and through another hole in the nipple of the second tubular section or plunger. The end is then sealed to prevent the lanyard from being pulled back through the second tubular section. In this manner, pulling on the knob compresses the spring of the center support assembly and depresses the plunger allowing one end of the support assembly to be freed from one of the brackets. At the same time the support assembly can be swung outward to change the roll of tissue. The support assembly will be held together by the lanyard, preventing the components from 'springing apart' from the bias supplied by the spring. The support assembly is held to one bracket by the lanyard but is free to swing or pivot about the flexible lanyard to replace the roll.

7 Claims, 5 Drawing Sheets

ROLL HOLDER WITH LANYARD FOR RETRACTING SUPPORT ASSEMBLY

BACKGROUND OF THE INVENTION

The present invention relates to an improved rolled material holder and more particularly to a rolled material holder which provides a holder for holding and dispensing rolled material, such as toilet tissue, paper towels and other such rolled material, which includes a release mechanism for aiding the replacement of the rolled material on the holder spindle.

This application is related to the Disclosure Document; No. 292069, entitled 'Improvement Relative to Single Roll Holders/Dispensers', filed with the U.S. Patent and Trademark Office on Sep. 26, 1991.

There are various types of rolled material holders available for all type of different materials. There are toilet tissue holders, paper towel holders, protective sheeting holders and holder for just about every rolled product in existence. The holders all typically have some sort of center supporting assembly between supporting brackets. In some instances the supporting assembly is a simple one piece spindle and in others it is constructed from a number of components acting together to support the rolled material.

In most of these rolled material holders, the center supporting assembly has to be removed from the supporting brackets to exchange the rolled material. The means of removing the supporting assembly also varies depending on the particular style of the holder. Typically, either the supporting brackets have to be flexed or repositioned or the supporting assembly contains a means of compression to remove the ends from the supporting brackets.

The supporting assembly having a means of compression, typically has a set of tubular members, one sliding within the other, and a spring which fits between the tubular sections to bias the sections outward from each other. Typically, when someone goes to replace the rolled material one end is first removed from one of the supporting brackets and then the empty core of the rolled material and the supporting assembly is removed completely from the brackets.

It is not uncommon that as the support assembly is being removed the supporting assembly springs apart into the various components. Most of the time this is somewhat expected and is most of the time a slight annoyance. Occasionally, the results of the 'spring apart' can have disastrous or embarrassing results. An example, when changing toilet tissue the support assembly some times flies apart. It has happened that one or more of the components have landed in the toilet.

Sometimes in the compressible supporting assembly, the supporting assembly is not easily reached to be compressed for removable. This is especially true for the elderly and the young. Therefore, there exists a need for a mechanism to assist and aid in the replacement of rolled material and to prevent the 'springing apart' of the components of the supporting assembly of a rolled material holder.

There has been some attempt in the past to address these problems. It is known in the art that there are push buttons mounted on the brackets which depress the end of the supporting assembly from the supporting bracket. These push buttons have been made in various configurations and applications. In all of the prior art, the supporting assembly is completely removed from the supporting brackets. It is unnecessary for the supporting assembly to be completely removed from the supporting brackets in most instances.

It is also known in the prior art to construct the supporting assembly with a sort of limiting pin which prevents the components from completely separating. But these limiting pins are not adaptable to all applications due to the particular construction materials used and the configuration of the components. In order to manufacture supporting assembly as economically as possible and to maintain competitive in the market, most manufactures have never incorporated or have eliminated the use of such limiting devices.

Accordingly, it is an object of the present invention to provide a rolled material holder that is adapted to assist in the removal and replacement of a roll of rolled material on a rolled material holder. With the rolled material holder of this invention it has been found that it is easy and convenient to change the roll of rolled material on a rolled material holder.

Another object of the present invention is to provide an improved rolled material holder that is constructed to provide a means of changing a roll of rolled material in which the supporting assembly will not fly apart into its various components.

A further object of the present invention is to provide an improved rolled material holder that is adapted to allow the supporting assembly to pivot rather then being completely removed from the supporting brackets.

Still another object of the present invention is to provide a rolled material holder that incorporates a knob for use in releasing an end of the supporting assembly from the supporting bracket.

Still a further object of the present invention is to provide a rolled material holder that is economically feasible to be incorporated into existing rolled material holders or assembled into a rolled material holder at the time of manufacturing which is affordable by the people.

Another object of the present invention is to provide a rolled material holder which can be used on many different types of rolled material.

Yet another object of the rolled material holder of this invention is to provide a rolled material holder which can be used in either a commercial or in domestic applications.

SUMMARY OF THE INVENTION

To accomplish the foregoing and other objects of this invention there is provided a rolled material holder, in the preferred embodiment described herein for illustration purposes, includes a conventional toilet tissue roll holder having a typical three piece center roll support assembly, or spindle, consisting of a first tubular section, a center spring, and a second tubular section or plunger. The second tubular section or plunger sliding within the first tubular section. The spring is situated between the first and second tubular sections to bias the sections outward. The tubular sections when assembled fits between a left and right bracket. Nipples on the first tubular section and second tubular section or plunger are positioned within bores contained on the left and right brackets. The spring provides enough bias to securely hold the center assembly and a roll of toilet tissue to the bracket.

The inventive concept of the invention, consists of adapting a conventional toilet tissue roll holder, or any other type of similar rolled material holder which incorporates the same principles, to include a knob and a lanyard to compress the spring to release one end of the center assembly from the bore in one of the brackets. One end of the lanyard is securely attached to the knob through a hole in the knob. The other end of the lanyard is inserted through a hole in one of the bores in one of the brackets and extended through a hole in the nipple of the first tubular section. The lanyard is then extended through the center of the spring contained within the first tubular section and through another hole in the nipple of the second tubular section or plunger. The end is then sealed to prevent the lanyard from being pulled back through the second tubular section.

In this manner the roll of toilet tissue, or other rolled material can be easily changed by pulling on the knob. Pulling on the knob compresses the spring and depresses the plunger, or second tubular section, allowing one end of the center assembly to be freed from one of the brackets. At the same time the center assembly can be swung outward to change the roll of tissue. The center assembly will be held together by the lanyard, preventing the three components from 'springing apart' from the bias supplied by the spring. The center assembly is also held to the opposite bracket by the lanyard but is free to swing or pivot about the flexible lanyard to replace the roll.

The above described objects, and other objects and features of the present invention will be better understood and appreciated from the following detailed description of the main embodiment thereof, selected for purposes of illustration and shown in the accompanying drawings.

DETAILED DESCRIPTION

Figure 1:
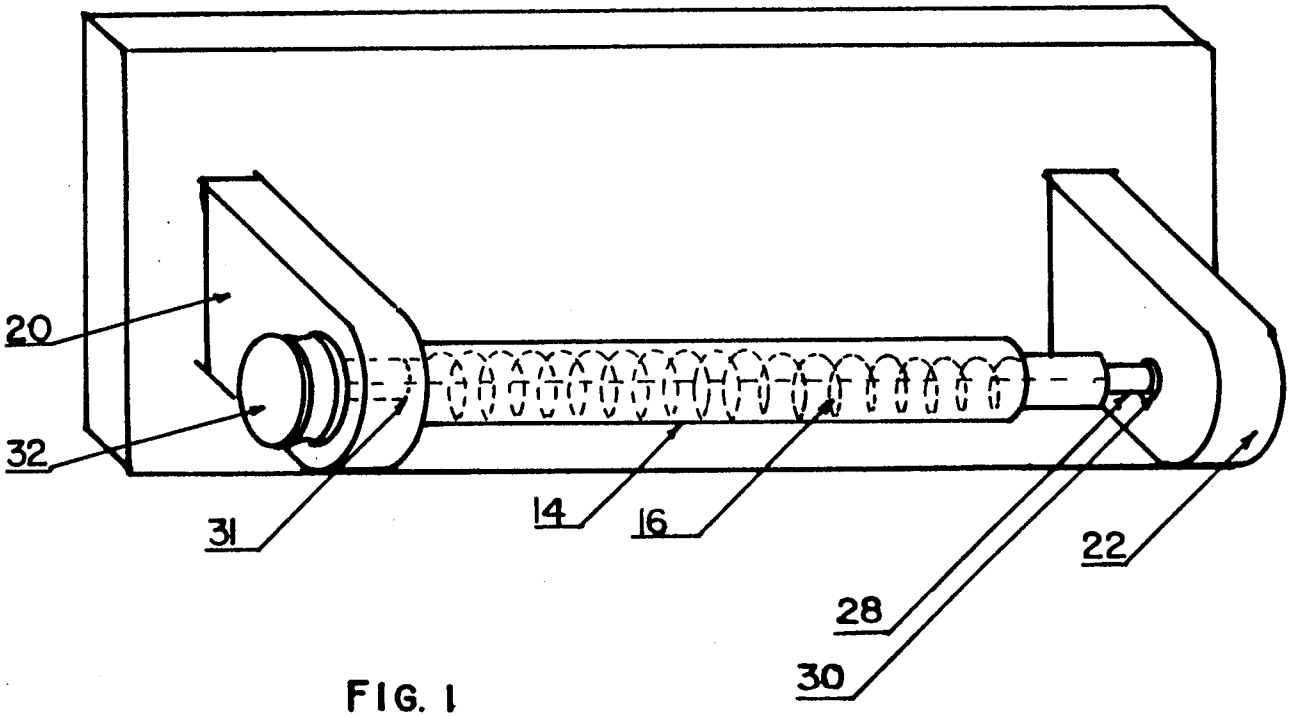
FIG. 1 is an illustration of the preferred embodiment incorporated on a toilet tissue holder.
Figure 2:
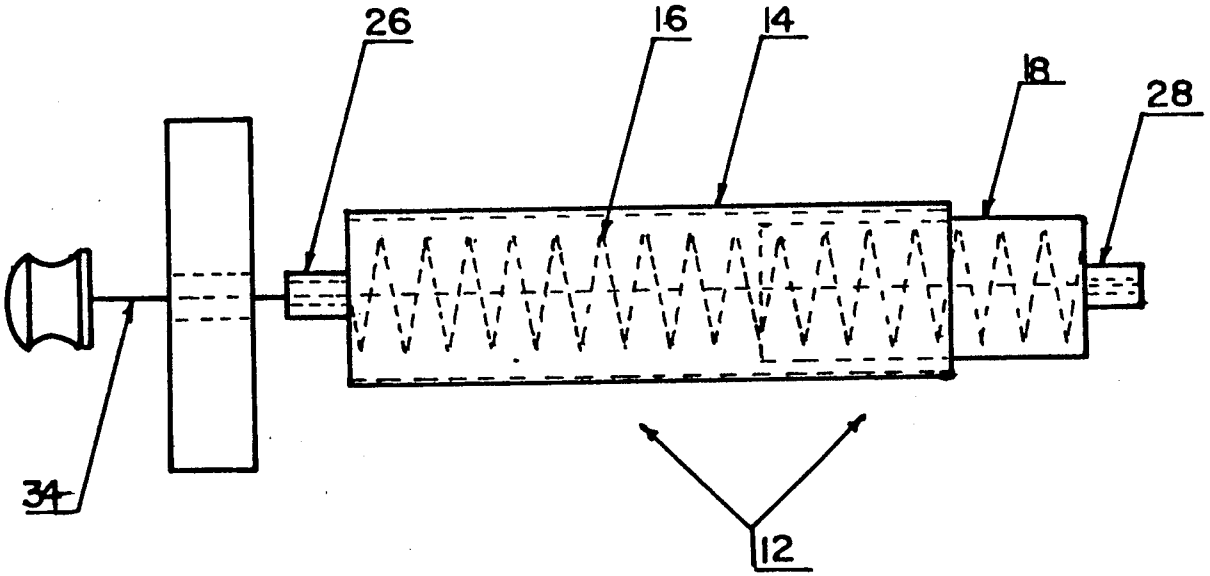
FIG. 2 is a partial view of the preferred embodiment showing more detail.

Referring now to the drawings, and in particular FIGS. 1 and 2, there is shown the preferred embodiment for the rolled material holder 10 and more particularly a rolled material holder 10 which provides a holder for holding and dispensing toilet tissue which includes a release mechanism for aiding the replacement of the rolled material on the holder spindle.

The rolled material holder 10, as illustrated and described, includes a convention toilet tissue roll holder having a typical 3 piece center roll support assembly 12, or spindle, consisting of a first tubular section 14, a center spring 16, and a second tubular section 18 or plunger. The second tubular section 18 or plunger sliding within the first tubular section 14. The spring 16 is situated between the first and second tubular sections 14 and 18 to bias the sections outward. The tubular sections 14 and 18 when assembled fits between a left 20 and right bracket 22. Nipples 26 and 28 on the first tubular section 14 and second tubular section 18, or plunger, are positioned within shallow bores 30 contained on the left and right brackets 20 and 22. The spring 16 provides enough bias to securely hold the support assembly 12, or spindle, and a roll of toilet tissue to the brackets 20 and 22.

The invention consists of an improvement by adapting the conventional toilet tissue roll holder to include a knob 32 and a lanyard 34 to compress the spring 16 to release a nipple 28 on one end of the support assembly 12 from the shallow bore 30 in one of the brackets 22. The knob 32 is drilled through the center and the lanyard 34 is securely attached to the knob 32 through the hole. The other end of the lanyard 34 is inserted through a hole drilled through the shallow bore 31 in one of the brackets 20 and extended through a hole drilled in the nipple 26 of the first tubular section 14. The lanyard 34 is then extended through the center of the spring 16 contained within the first tubular section 14 and through another hole drilled through the nipple 28 of the second tubular section 18 or plunger. The end of the lanyard 34 is then sealed to prevent the lanyard 34 from being pulled back through the hole in the nipple 28 on the support assembly 12.

In operation pulling on the knob 32 compresses the spring 16 and depresses the plunger 18 allowing the nipple 28 of the support assembly 12 to be freed from one of the brackets 22. At the same time the support assembly 12 can be swung outward to change the roll of tissue. The lanyard is typically made of a flexible material. The support assembly 12 will be held together by the lanyard 34, preventing the three components (14, 16 and 18) from 'springing apart' from the bias supplied by the spring 16 when the support assembly is being removed from the brackets 20 and 22. The support assembly 12, or spindle, is held to the other bracket by the lanyard 34 but is free to swing or pivot about the flexible lanyard 34 to replace the empty roll of material with a new roll.

The preferred embodiment and the best mode contemplated of the rolled material holder 10 of the present invention are herein described. However, it should be understood that the best mode for carrying out the invention hereinafter described is offered by way of illustration and not by the way of limitation. The inventive concept of this invention can be applied to any rolled material holder 10 which incorporates a center support assembly 12 or spindle for holding the rolled material, such as paper towels, wrapping paper, protective sheeting, wallpaper, bolts of material, or any other type of rolled material, in either a domestic or commercial application. Therefore, it is intended that the scope of the invention include all modifications and applications which incorporate its principal design features.

The rolled material holder 10 of this invention provides an improvement over a conventional rolled material holder. The inventive concept of this invention makes it easier and more convenient to change the roll of rolled material from the center support assembly 12. The conventional rolled material holder typically has a center support assembly 12, which is supported between a first and second bracket 20 and 22 by corresponding first and second ends 26 and 28 of the support assembly 12 which engage the inside of the brackets 20 and 22. The support assembly 12 supports and holds the rolled material for dispensing.

There are several different types of support assemblies available on the market. The inventive concept of this invention can be applied to most if not all the known support assembly, although some slight modifications and arrangements may have to be made. The applications can be in either a domestic or in a commercial setting and can be applied to several different products including toilet tissue, paper towels, bolts of material, protective sheeting and just about any other rolled material having a center core. In the illustrations and descriptions herein, the rolled material is toilet tissue so all discussions are in regards to a toilet tissue roll holder.

The most common type of center support, as illustrated in FIGS. 1 and 2, consist of three components. These components are a first tubular section 14, spring 16 and second tubular section 18. The tubular section 14 and 18 typically have a diameter which easily is accommodated within a center core of a roller material. The second tubular section 18 has a slightly smaller outside diameter then the inside diameter of the first tubular section 14. This allows the second tubular section 18 to slide within the first tubular section in a telescoping movement.

The spring 16 is typically placed within the tubular sections 14 and 18 to provide an outward bias. The tubular sections 14 and 18 typically have end nipples 26 and 28 on the outer ends of the sections when they are assembled. The nipples 26 and 28 fit within shallow bores 30 and 31 on the left and right brackets 20 and 22. This arrangement properly positions and holds the support assembly on the brackets 20 and 22.

The improvement of this invention consists of a knob 32 and a lanyard 34 added to an otherwise conventional rolled material holder. The improvement can be easily added at the time of manufacturing or can be added to existing rolled material holders. The knob 32 is typically placed on the outside of the first bracket 20 holding a support assembly 12. The knob 32 aids in releasing one end of the support assembly 12 from a bracket 22 when pulled. The lanyard 34 is attached to the support assembly 12 to prevent the support assembly 12 from coming apart, when an end of the support assembly 12 is released from a bracket 22, and to hold the support assembly 12 to one of the brackets 20 yet allowing the support assembly 12 to pivot about the lanyard 34 to change or replace the rolled material.

The lanyard 34 has a first and second end. One of the ends is attached to the support assembly 12. The lanyard 34 interacts with one of the brackets 20 or 22, such that the support assembly is held to the bracket 20 and may pivot about the lanyard 34 when one end of the support assembly 12 is released from one of the brackets. The lanyard 34 is typically constructed from a flexible cord such as a small diameter steel cable or a plastic cord. The particular application and the material of which the rolled material holder is constructed from generally being the determining factors in deciding what type of material the lanyard is constructed.

In the preferred embodiment, as illustrated in FIGS. 1 and 2, the lanyard 34 extends through a hole centered in the shallow bore 31 in the first bracket 20 and the first end is attached to the knob 32, such that when the knob 32 is pulled the lanyard 34 is acted upon. The lanyard 34 is threaded through the nipple 26 on the first tubular section 14 and the center of spring 16 contained within the tubular sections 14 and 18. The second end of the lanyard 34 is attached to the end nipple 28 on the second tubular section 18 of the support assembly 12. The nipple 28 engages the shallow bore on the inside of the second bracket 22. In this manner, when the knob 32 is pulled the lanyard 34 acts upon the second tubular section 18 of the support assembly 12 to compress the spring 16 and to release the nipple 28 of the support assembly 12 from the shallow bore 30 on the inside of the second bracket 22.

In another embodiment, not shown, the lanyard 34 extends along an outer surface of the support assembly 12 rather than through the center. This embodiment is typically used on a support assembly 12 which is not hollow the entire length but generally operates as described above. The exact configuration in the various application may vary depending on the particular material and application. However, typically the configuration is similar to the preferred embodiment described above with some slight variations.

The lanyard, in this embodiment, typically is threaded through a small bore which extends through the nipple of the first tubular section to the outer surface of the same tubular section on the support assembly. The lanyard then extends along the outer surface to the second tubular section to a small bore. This small bore extends from the outer surface of the second tubular section through the end of the nipple on the second tubular section. The end of the lanyard is attached to the nipple such that as the knob is pulled the lanyard retracts the second tubular section to release the nipple from a shallow bore on the supporting bracket.

Figure 3:
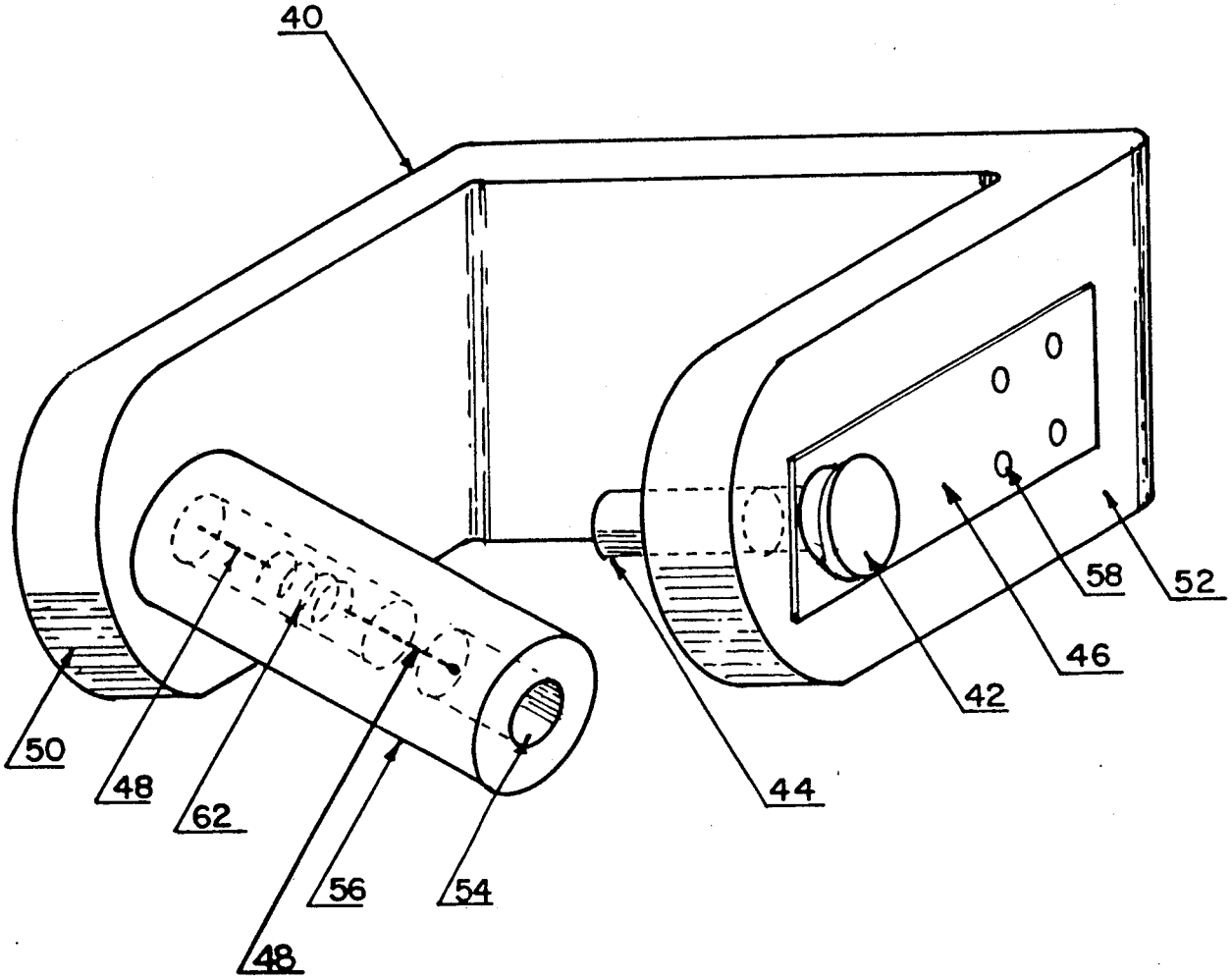
FIG. 3 is another embodiment of the rolled material holder.

In another embodiment, as illustrated in FIG. 3, the knob 42 on the rolled material holder 40 includes an extension rod 44 and a spring 46. In this embodiment the second end of the lanyard 48 is attached to the second bracket 50. The extension rod 44 extends through a hole in the first bracket 52 to engage an opening 54 in one end of the support assembly 56 to securely hold the support assemble 56 in proper position in the rolled material holder 40. The spring 46 provides the necessary bias to maintain the extension rod 44 in engagement with the opening 54 in the end of the support assembly 56. The lanyard 48 extends through the support assembly 56 and is attached to the support assembly 56 in the bottom of the opening 54. In this manner, as the knob 32 is pulled the extension rod 44 is released from the opening 54 on the support assembly 56 releasing the end of the support assembly from the bracket 52. The support assembly 56 pivots about the lanyard 48 which is attached to the bracket 50 to allow the rolled material to be easily changed.

The spring 46, as shown on FIG. 3, consists of a flat spring. The flat spring may be attached to the bracket 52 by rivets 58 or by any other suitable means known in the art. The flat spring would be of sufficient thickness and width to provide the necessary bias to securely engage the extension rod 44 in the opening 54 in the support assembly 56. The spring 46 in this embodiment is attached to the lower surface of the knob 42 which faces the bracket 52. As the knob 42 is pulled the flat spring flexes to provide the necessary bias.

Figure 4:
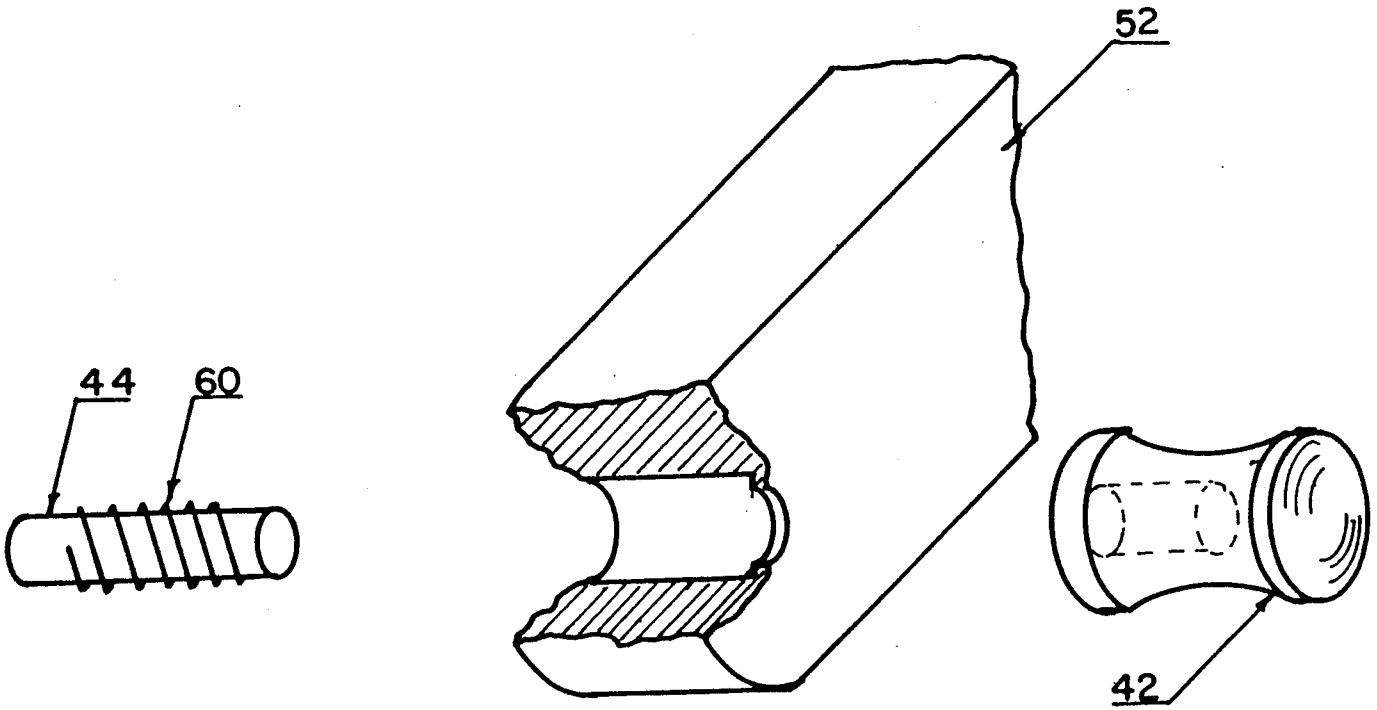
FIG. 4 illustrates another spring used in an embodiment of this invention.
Figure 5:
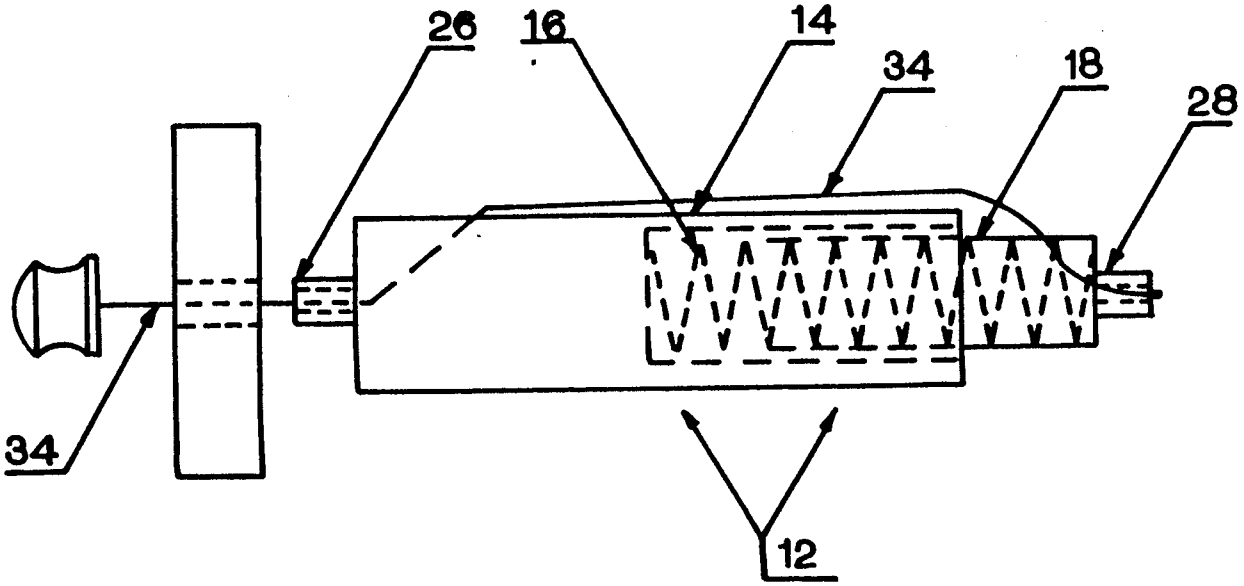
FIG. 5 illustrates another embodiment of the rolled material holder in which the lanyard extends along the outer surface of the support.

FIG. 4, illustrates a compression spring 60 which may also be utilized to supply the necessary bias the extension rod 44. The compression spring 60 is positioned around and attached to the extension rod 44. The compression spring 60 is contained within a bore centered on the same hole as used by the extension rod 44 on the bracket 52. The compression spring 60 typically enters the bore from the inside surface of bracket 52, so the compression spring acts upon the inside of the bore when the knob 42 is pulled.

FIG. 3 illustrates a spring assembly 62 contained on the lanyard 48. The spring assembly 62 is incorporated into the lanyard 48 between the first and second ends of the lanyard 48. The spring assembly 48 is used to take up excessive slack in the lanyard 48 and to provide additional extension of the lanyard 48 which may be require to allow the support assembly 56 to pivot about the lanyard 48 for changing the roll of rolled material. The spring assembly may or may not be needed depending on the particular application and the construction material of the lanyard 48. The spring assembly 62 is shown on one embodiment but it may be included in any, all or none of the embodiments as required.

The bracket which receives the free end of the support assembly may also include a recession (not shown) on the inside surface of the bracket for assisting the replacement of the free end of the support assembly into the shallow bore. This recession would be typically funnel shaped with the narrow portion aiming towards the shallow bore. The wide portion of the funnel shape would start even with the inside surface of the bracket. The narrow portion of the funnel shaped recession would taper into the bracket to a dept slightly less than the dept of the shallow bore. In this manner, as the support assembly is being replaced into the bracket, the freed nipple would be pushed into the funnel opening on the inside of the bracket. As the support assembly is pushed inward, the nipple would follow the tapered funnel shape to the shallow bore. When the nipple reached the bore it would further extend into the bore to securely hold the support assembly in the proper position.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A rolled material holder having a center support assembly, which is supported between a first and second bracket by corresponding first and second ends of said support assembly engaging the inside of said brackets, for supporting and for dispensing the rolled material, the improvement comprising:

a knob on the outside of said first bracket, said knob releasing one end of said support assembly from one of said brackets when pulled; and a lanyard, said lanyard having a first and second end, one of said ends being attached to said support assembly and said lanyard engaging one of said brackets, such that said support assembly pivots about the lanyard when one end of said support assembly is released from one of said brackets, said lanyard engaging said first bracket by insertion into and extension through a hole in said first bracket and being attached to said knob, such that when said knob is pulled said lanyard and said support assembly are acted upon.

2. The rolled material holder as set forth in claim 1 in which said lanyard acts upon said support assembly, said first end of said lanyard attached to said knob and said second end of said lanyard attached to said second end of said support assembly, said second end of said support assembly engaging a bore on the inside of said second bracket, such that when said knob is pulled said lanyard acting upon said second end of said support assembly releases said second end of said support assembly from said bore on the inside of said second bracket.

3. The rolled material holder as set forth in claim 2 in which said lanyard extends through the center of said support assembly.

4. The rolled material holder as set forth in claim 2 in which said lanyard extends along an outer surface of said support assembly.

5. The rolled material holder as set forth in claim 1 in which said lanyard extends through a hole in said first bracket and is attached to said knob, said first end of said lanyard attached to said knob and said second end of said lanyard attached to said second end of said support assembly, said second end of said support assembly engaging a bore on the inside of said second bracket, such that when said knob is pulled said lanyard acting upon said second end of said support assembly compresses said support assembly and releases said second end of said support assembly from said bore on the inside of said second bracket.

6. A rolled material holder having a center support assembly, which is supported between a first and second bracket by corresponding first and second ends of said support assembly engaging the inside of said brackets, for supporting and for dispensing the rolled material, the improvement comprising:

a knob on the outside of said first bracket holding a support assembly, said knob releasing one end of said support assembly from a bracket when pulled; and a lanyard, said lanyard having a first and second end, said first end attached to said knob and said second end attached to said second end of said support assembly and said lanyard extending through a hole in said first bracket, such that said support assembly may pivot about the lanyard when said second end of said support assembly is released from said second bracket, said second end of said support assembly engaging a bore on the inside of said second bracket, such that when said knob is pulled said lanyard acting upon said second end of said support assembly compresses said support assembly and releases said second end of said support assembly from said bore on the inside of said second bracket.

7. A method of providing a rolled material holder, the steps of which comprises:

attaching a knob on the outside of a first bracket holding a support assembly within a rolled material holder, said knob releasing one end of said support assembly from a bracket when pulled; and attaching a lanyard to said support assembly, said lanyard having a first and second end, one of said ends being attached to said support assembly and the other of said ends being attached to said knob and said lanyard engaging one of said brackets, such that said support assembly may pivot about the lanyard when one end of said support assembly is released from one of said brackets when said knob is pulled and said lanyard and said support assembly are acted upon.

* * * * *